United States Patent [19]

Blanyer

[11] 4,070,560

[45] Jan. 24, 1978

[54] TRANSIT ZONE MONITOR CIRCUIT

[75] Inventor: Carl G. Blanyer, Thousand Oaks, Calif.

[73] Assignee: Abex Corporation, New York, N.Y.

[21] Appl. No.: 743,931

[22] Filed: Nov. 22, 1976

[51] Int. Cl.[2] ..... G08G 1/065; G06M 3/14

[52] U.S. Cl. ..... 235/92 TC; 235/92 EV; 235/92 R; 364/437

[58] Field of Search ..... 235/92 TC, 92 EV, 150.24; 340/31 R, 23; 246/77, 34 R, 34 CT, 122 R, 133–134, 146, 167 R

[56] References Cited

U.S. PATENT DOCUMENTS

| | | | |
|---|---|---|---|
| 3,144,225 | 8/1964 | Suerkemper et al. | 246/77 |
| 3,254,324 | 5/1966 | Casciato et al. | 235/150.24 |
| 3,284,614 | 11/1966 | Bramer | 235/92 TC |
| 3,486,008 | 12/1969 | Mori | 235/92 TC |

*Primary Examiner*—Joseph M. Thesz

*Attorney, Agent, or Firm*—Kinzer, Plyer, Dorn & McEachran

[57] ABSTRACT

A zone monitor circuit for a transit zone having plural entry-exit ports each equipped with a sensor that generates an arrival pulse signal when a vehicle or other movable object passes through the port into the zone and that generates a departure pulse signal whenever an object passes through the port out of the zone, comprising a synchronization circuit which develops time-segregated arrival and departure signals, an occupancy counter that maintains a continuous count of the total number of arrival signals minus departure signals to afford an occupancy count representative of the number of objects within the zone and a vacancy signal indicative of an empty zone, a departure anticipation counter for developing an impending vacancy signal upon occurrence of a predetermined number of departure signals with no intervening arrival signals, and a path indicator circuit which generates binary coded path indication signals identifying traffic ports of entry and exit.

18 Claims, 5 Drawing Figures fig.1.
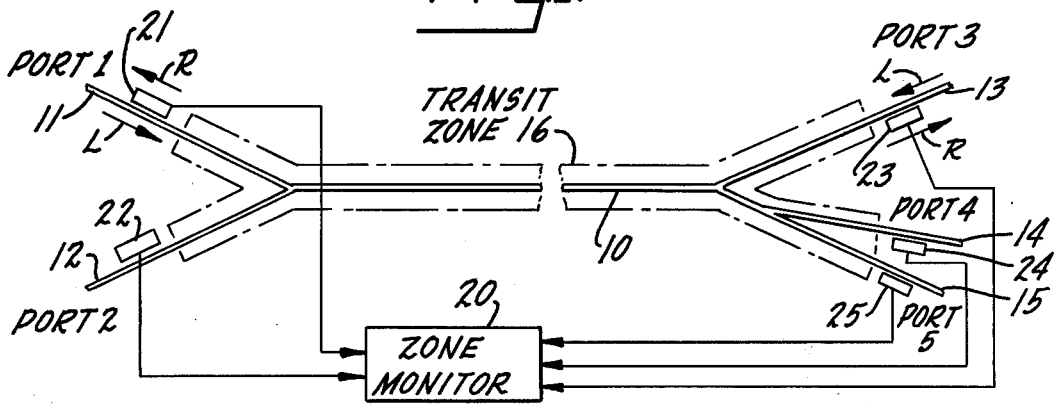
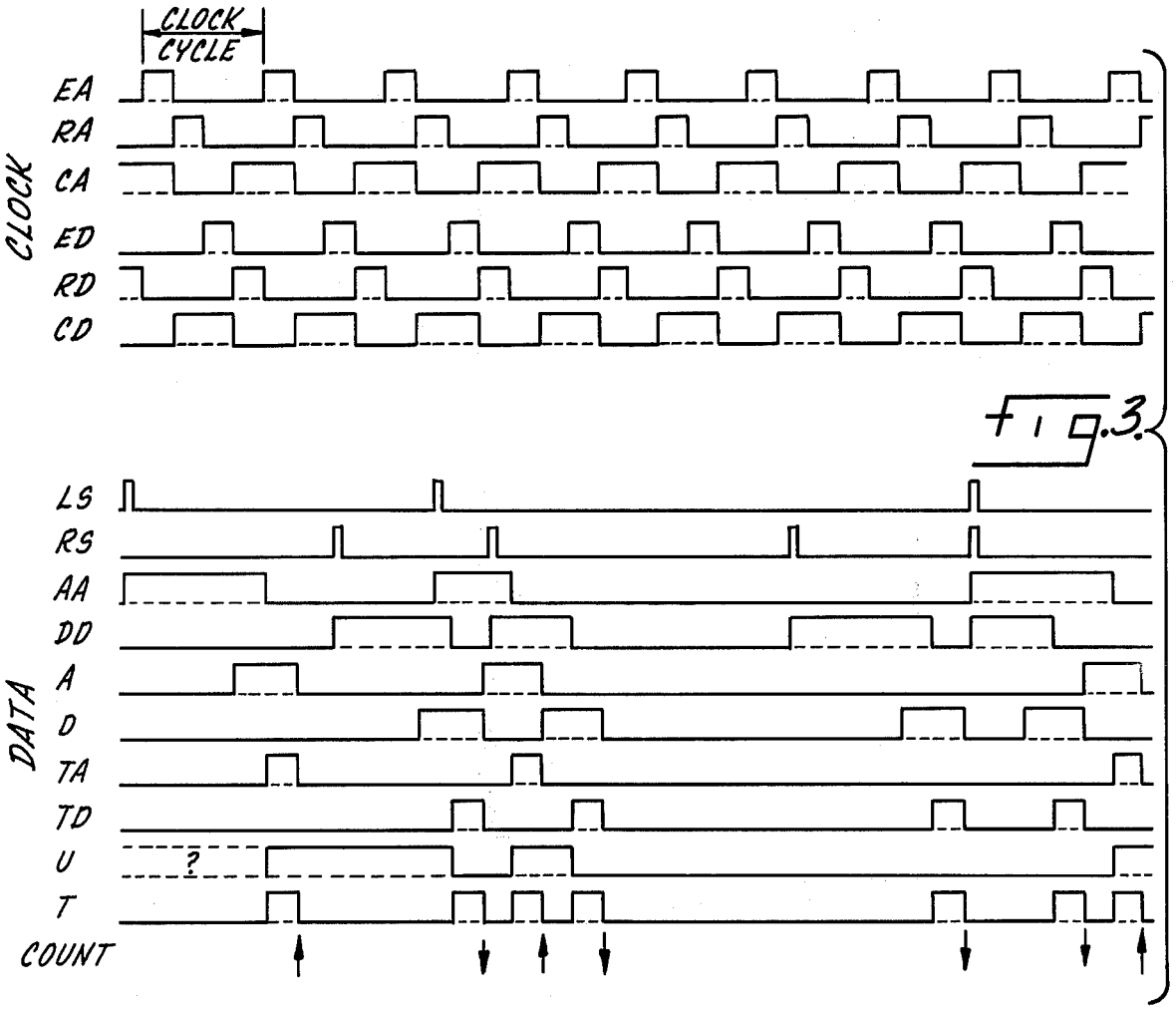
fig.3.

TRANSIT ZONE MONITOR CIRCUIT

CROSS REFERENCE TO RELATED APPLICATION AND PATENT

The present invention is particularly suited to the use of standardized arrival and departure signals, indicative of movements of objects past an object sensor, as generated by moving-object sensors as described in Blanyer U.S. Pat. No. 3,721,859 incorporating interface logic circuits of the kind described and claimed in the copending application of Carl G. Blanyer Ser. No. 743,533, filed concurrently herewith; however, appropriate input signals from other sensors may also be employed to actuate the zone monitor circuit of the present invention.

BACKGROUND OF THE INVENTION

The term "zone" is used in this application to identify a line or network of railway track, a line or network of roadway for other vehicles, or a section of some other form of traffic system for moving objects. The limits of the zone are defined by a plurality of "ports" through which vehicles or other objects may move as they arrive in or depart from the zone. These general words "zone" and "port" have been selected to minimize possible conflict with other terms having different and well established meanings in given transportation or conveyor systems, such as the term "block" as applied to railway systems.

A simple but important concept in traffic monitoring is the primary operation of determining when a zone is vacant and when it is occupied. A related secondary operation constitutes determination of the route followed by a particular stream of traffic in moving through the zone. Specifically, this entails the identification of the ports of arrival and departure. In a railway system or other vehicular system based upon wheel sensors that identify the movement or vehicle wheels through the sensors, it is obviously inadequate to limit the concept of identification of the presence of a wheel in the sensing zone of a sensor. Some other means is necessary for determination of the presence of a vehicle in the zone indirectly from the history of wheel movements through the zone ports. Similar considerations apply to other moving object traffic systems.

There are two basic ways to make the appropriate determination of object presence in the zone. The first entails a computation of object location from a determination of time and velocity data during transit through an arrival port. The second is by accumulated counting of wheel movements (or object movements) into and out of the monitored zone.

The time-velocity computation method, especially as applied to a vehicular transit zone, makes use of approximately known maximum distances between axles of various forms of rolling stock. If the vehicle speed is measured as the wheels pass through an arrival port, a relatively straightforward computation can predict the time limits between which successive wheel detections must occur. If no wheel passes through the access port within that time interval, a reasonable inference is created that there are no additional wheels available to pass through the port. That is, the traffic is gone.

However, this technique has two major flaws that render it quite unsuitable for general use. There is a substantial uncertainty in timing that is inherent in the system, an uncertainty made worse by any acceleration or deceleration. This inherent uncertainty translates into substantial doubt with respect to the location of the zone boundaries. In addition, the speed-time computation technique becomes unmanageable as the velocities approach zero. If reversal of movement of the objects is permitted, as can occur in almost any vehicular system, the velocity-time computation technique is rendered completely unreliable to the point of presenting a continuing danger to the moving objects and to any personnel involved.

In the second basic technique, with cumulative counting of arriving wheels (or objects) and continuous subtraction of departures from the arrival count, any accumulated count signifies the presence of traffic within the zone. A zero net count identifies a vacant zone condition. This technique has essentially no inherent uncertainty, but may be compromised by data input errors. Thus, the effectiveness of a zone monitor circuit based upon this second basic technique is dependent upon the effective elimination of probable errors.

Input data errors may include errors of omission, as when a sensor fails to detect the passage of a wheel or object into or out of the zone; conversely, spurious signals may indicate an arrival or departure through a port when no object is actually present. The consequences are false presence or vacancy determinations by the zone monitor. A secondary consequence may be an incorrect indication of the path of traffic movement through the zone.

Imperfect sensors and installations may cause an occasional object passage (or wheel passage) to be missed. A highly desirable goal for a zone monitor is to provide effective compensation for missed signals at a ratio of about one in several hundred; a monitor with this capability is relatively undemanding with respect to sensor condition and installation.

A false determination that the zone being monitored is vacant is highly undesirable and frequently dangerous. A total lack of response to arriving traffic is all but inconceivable. However, an initial failure to respond may cause a momentary false vacancy indication while traffic is actually present. In particular, a false vacancy indication may occur after a part of a traffic stream is within the zone or before it has completed departure from the zone. Cases of this kind may be viewed as an uncertainty in the location of the zone boundaries.

On the other hand, a false determination of traffic presence within the zone when the zone is in fact vacant is reasonably safe. This condition might be considered only a nuisance except that, if the monitor has no corrective mechanism, the false indication may persist indefinitely because the counting register must have an indefinitely long memory. Thus, an error of this nature can effectively disable the system.

A totally different kind of error can result from simultaneous application of arrival and departure signals to the zone monitor. This might appear to be statistically unlikely or even impossible, particularly when the output signals from the port sensors supplying data to the zone monitor are made exceedingly brief in comparison with the actual time of object passage through the sensors. In many systems, however, coincident arrival and departure signals can occur and may present a potentially major problem.

Thus, in railway systems and other vehicular systems, arrival and departure signals from the wheel sensors of the system are not uncorrelated in time. In a train of railway cars of identical dimensions, the sets of signals supplied by the wheel sensors form a pattern. Depending upon the car dimensions and the displacement between sensor locations, the pattern may cluster around possible coincidence and multiple near-coincident arrival and departure signals may occur. Rare errors brought about in this manner might well be tolerable except for an additional factor; unless positive steps are taken to avoid the difficulty, an otherwise acceptable system might generate errors much more serious than a single miscount when a coincidence situation develops. Thus, the responses may be indeterminate or difficult to predict. The overall effect may be what amounts to a latch-up of the system, a total counter reset, or other gross change.

SUMMARY OF THE INVENTION

It is a principal object of the present invention, therefore, to provide a new and improved transit zone monitor circuit, of the kind that utilizes a cumulative arrival-departure counter to determine the presence or absence of objects within the monitored zone, that effectively and inherently compensates for input data errors of the kinds most likely to occur.

Another object of the invention is to provide a new and improved zone monitor circuit, of the cumulative arrival-departure counter type, capable of consistent and accurate zone occupancy determinations despite possible coincidence between arrival and departure inputs.

Another object of the invention is to provide a new and improved monitor circuit for a transit zone having multiple entry/exit ports that affords an accurate indication of the path followed by traffic passing through the zone in a digital form readily usable by display and computation apparatus.

A further object of the invention is to provide a new and improved cumulative arrival-departure count zone monitor that makes an advance determination of an impending vacancy condition for the zone.

BRIEF DESCRIPTION OF THE DRAWINGS

FIG. 1 is a schematic illustration of a transit zone in which the zone monitor circuit of the present invention may be employed;

FIG. 3 is a timing chart for signals in the zone monitor circuit of FIG. 2;

DESCRIPTION OF THE PREFERRED EMBODIMENTS

Figure 2:
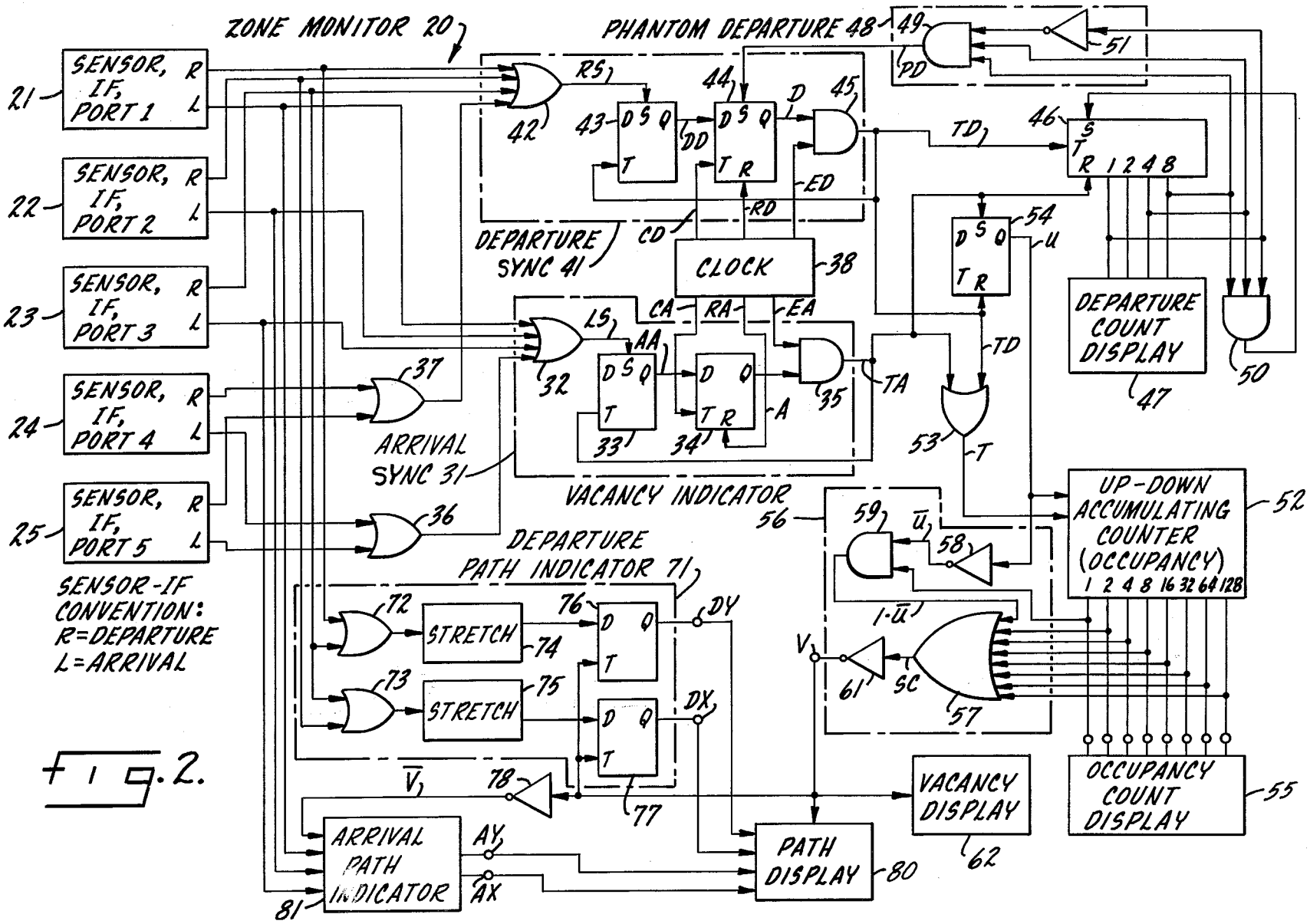
FIG. 2 is a simplified diagram, partially schematic and partially in block form, of a zone monitor circuit constructed in accordance with one embodiment of the present invention.

FIG. 1 illustrates the environment of the present invention as applied to a railway system or other vehicular traffic system. The illustrated segment of the overall traffic system comprises a central track (or roadway) 10 having two tracks 11 and 12 connected to one end and three additional tracks 13, 14 and 15 are connected to the other end, affording five entry/exit ports. Five wheel sensors 21–25 are individually associated with the port tracks 11–15, respectively. The wheel sensors 21–25 conjointly define the outer limits of a transit zone 16 that encompasses the central track 10 and a limited portion of each of the tracks 11–15.

Each of the wheel sensors 21–25 is coupled to a zone monitor 20 that continuously monitors the occupancy status of transit zone 16. For purposes of the present explanation, it may be assumed that each wheel sensor is of the kind described in Blanyer U.S. Pat. No. 3,721,859 and is equipped with an interface circuit of the kind described in the copending application of Carl G. Blanyer, Ser. No. 743,533, filed concurrently herewith. A sensor of this kind, thus equipped, develops a brief, standardized output signal pulse, on one output terminal, in response to movement of a vehicle wheel through the sensor from left to right, when viewed from the sensor side of the track or roadway, as indicated by the arrows R associated with sensors 21 and 23. A similar pulse signal, on a different output circuit, is produced by the sensor in response to each wheel movement through the sensor in the opposite direction, from right to left as viewed from the sensor side of the track; see the arrows L. For convenience in the following description of zone monitor 20, sensors 21–25 are all mounted adjacent the port tracks 11–15 with an orientation such that the R signal from each sensor always indicates the departure of a wheel from zone 16. Conversely, each of the L signals is indicative of movement of a wheel into transit zone 16 and thus constitutes an arrival signal.

One preferred construction for zone monitor circuit 20 is illustrated in FIG. 2. As shown therein, the L (arrival) signal from each of the sensors 21, 22 and 23 is applied to an OR gate 32 in an arrival synchronization circuit 31 that forms a part of a synchronization means for developing synchronized arrival and departure signals segregated from each other on a time basis. The two closely adjacent sensors 24 and 25 (see FIG. 1) are treated as if they pertained to a single entry/exit port for the transit zone. The L (arrival) outputs of sensors 24 and 25 are connected to an input of gate 32 through an OR gate 36. The output of gate 32, designated LS, is connected to the set input of a preliminary storage stage comprising a flip-flop 33. The Q output of flip-flop 33 is connected to the D input of another flip-flop 34, constituting a secondary state of storage, and the Q output of flip-flop 34 is connected to one input of an AND gate 35. The output of gate 35 is connected back to the T input of flip-flop 33.

Timed actuation of the operations performed in the arrival synchronization circuit 31 are controlled by three signals CA, RA and EA from a clock circuit 38. The relative timing of these clock signals is discussed more fully hereinafter in connection with FIG. 3.

Zone monitor circuit 20, as shown in FIG. 2, includes a departure synchronization circuit 41 that is a substantial duplicate of the arrival synchronization circuit 31. Thus, circuit 41 includes an input OR gate 42 having individual input connections from the R (departure) outputs of the wheel sensors 21, 22 and 23. An additional input to gate 42 is derived from the R outputs of sensors 24 and 25 through an OR gate 37. The output of gate 42 is connected to a first storage device comprising a flip-flop 43 which is in turn connected to a second storage flip-flop 44. The output stage of departure synchronization circuit 41 is an AND gate 45 having its output connected back to flip-flop 43 for reset. The timing of operations in circuit 41 is controlled by three signals CD, RD and ED from clock 38.

The output of AND gate 45 in departure sync circuit 41 is connected to the count-incrementing input of a departure counter 46. The output of gate 35 in arrival sync circuit 31 is connected to a reset input for counter 46, one which resets the counter to zero. Device 46 is a conventional digital counter affording four binary outputs which are connected to a departure count display 47 that provides a visual readout of the count in counter 46.

Counter 46 is a part of a departure anticipation means, in zone monitor circuit 20, that also includes a phantom departure circuit 48. Circuit 48 includes an AND gate 49 having two inputs derived directly from the third and fourth level binary outputs of counter 46. A third input to gate 49 is derived from the first binary level output of counter 46, through an inverter 51. The output of gate 49, which comprises an impending vacancy signal for zone 16, is connected to an overriding set input S of flip-flop 44 in the departure sync circuit 41.

An up-down accumulating occupancy counter 52 is incorporated in zone monitor circuit 20 and is utilized to maintain a continuous count of the number of arrival signals supplied to the zone monitor minus the number of departure signals. The count input to counter 52 is derived from an OR gate 53, the inputs to gate 53 being taken from the AND gates 35 and 45 in the two synchronization circuits 31 and 41. Counter 52 is of the kind that utilizes a steering input to determine whether an applied count is used to increment or decrement the total count in the counter. This steering input U is supplied from a flip-flop 54 having a set input connected to the output of AND gate 35 and a reset input connected to the output of AND gate 45.

Counter 52 has eight levels of binary output, all connected to an occupancy count display 55. Display 55 affords a continuous indication of the total occupancy of transit zone 16 (FIG. 1) on the basis of number of wheels for a railway or other vehicular system; the count shown by display 55 could represent the total number of objects in the zone in a system in which each object is sensed.

Counter 52 also provides the basic input data for a vacancy indicator circuit 56. Circuit 56 includes an OR gate 57 having an individual input from each of the counter output representative of the second through the eighth binary levels. The first binary level output of counter 52 is connected to one input of an AND gate 59 in circuit 56. A second input to gate 59 is derived from the U output of flip-flop 54 through an inverter 58. The output of gate 59 is coupled to one input of OR gate 57. The output of vacancy indicator 56, derived from an inverter 61 connected to the output of gate 57, is a vacancy signal which, when logically true, indicates that transit zone 16 (FIG. 1) is vacant.

In zone monitor circuit 20, FIG. 2, a departure path indicator circuit 71 generates path indication signals indicating the ports used by traffic leaving the transit zone. Circuit 71 includes two input OR gates 72 and 73. Gate 72 receives inputs from the R (departure) outputs of sensors 21 and 23. The R inputs to gate 73 are derived from sensors 22 and 23. The output of gate 72 is applied to the input of a time delay (stretch) circuit 74, which may comprise a conventional one-shot circuit. A similar stretch circuit 75 is provided in the output of gate 73. The output of circuit 74 is connected to the D input of a storage flip-flop 76, whereas the output of stretch circuit 75 is connected to the D input of a flip-flop 77. The Q outputs of flip-flops 76 and 77, terminals DX and DY, are connected to a path display 80.

An arrival path indicator circuit 81, incorporated in zone monitor 20, may correspond fully in construction to the departure path indicator 71. The two outputs AX and AY of indicator circuit 81 are connected to the path display 80, which also has a vacancy signal input. Circuits 71 and 81 each include an input connection from vacancy indicator 56, the vacancy signal V being supplied to indicator 81 through an inverter 78.

The purpose of the synchronization means in zone monitor 20, comprising circuits 31, 38 and 41, is to convert quasi-random asynchronous input signals from sensors 21–25 into non-coincident, time synchronized output signals. The inputs occur in two trains of pulses, the arrival signals L and the departure signals R. Each pulse train may originate from any one of the sensors 21–25 associated with ports 1 through 5 of transit zone 16 (FIG. 1). Arrival signal pulses may coincide with or at least overlap with departure signal pulses. For any traffic moving through the transit zone, and excluding errors of either omission or commission, there is one departure signal pulse for each arrival signal pulse. The synchronization means 31, 38, 41 generates an output signal for each input signal, with the arrival and departure signal outputs from the synchronizers segregated from each other on a time basis; they must not overlap.

This is accomplished, in each of the synchronization circuits 31 and 41, in four steps; the steps are identical in both channels but have staggered timing. The first step, of course, is the simple OR function at the input of each synchronization circuit, funnelling all possible inputs into one. Thus, the LS output signal from OR gate 32 in the arrival synchronization circuit 31 comprises randomly occurring pulses each identifying movement of a wheel (or object) into transit zone 16 through any of the various ports 1 through 5. The RS output signal from OR gate 42 in the departure synchronization circuit 41 is, similarly, a series of randomly occurring pulses indicative of departures from the transit zone, regardless of port.

In synchronization circuit 31, the second operational step is storage of LS arrival signals in a preliminary storage stage comprising flip-flop 33. That is, each LS pulse (see FIG. 3) is supplied to asynchronous direct-set input of flip-flop 33 for preliminary storage. The stored signal, designated AA (FIGS. 2 and 3), is stored as long as needed. It could be clocked out directly to an output stage such as AND gate 35, but this might produce an occasional splinter output as a result of near coincidence between the clock and input signals. For this reason, the second storage flip-flop 34 is incorporated in circuit 1, entailing a third operational step in which signal AA is clocked into flip-flop 34 by signal CA from clock 38. The output of storage device 34 is now the stored arrival signal A, which is retained in storage until needed and subsequently is erased by resetting of flip-flop 34 in response to the timing signal signal RA from clock 38.

In the fourth and final step of operation for circuit 31, the stored arrival signal A is keyed out by the enabling clock signal EA applied to AND gate 35. The output signal TA from gate 35 is a count signal utilized to increment counter 52. The leading edge of signal TA resets the preliminary storage flip-flop 33 in arrival synchronization circuit 31; by reference to FIG. 3 it can be seen that the initial signal LS that set flip-flop 33 has disappeared well prior to occurrence of a TA signal pulse.

The sequence of operations in departure synchronization circuit 41 is the same as for arrival synchronization circuit 31. A pulse signal R from any of the sensors 21–25 passes through OR gate 42, appearing as an RS signal pulse that is recorded in the preliminary storage stage of circuit 41, flip-flop 43. At a time determined by clock signal CD a DD signal from flip-flop 43 is recorded in flip-flop 44. At a time determined by clock signal ED, the stored departure signal D from flip-flop 44 is read out through AND gate 45, providing a timed departure signal TD that is employed to reset flip-flop 43.

The secondary stored arrival and departure signals A and D cannot coincide in time, as will be apparent from the timing charts of FIG. 3. In those instances when inputs RS and LS pulses occur at or near coincidence with each other, the fall of A and the rise of D or vice versa may be simultaneous, but the adjacent edges of the timed arrival and departure pulses TA and TD are always separated by at least one basic clock interval and hence create no "hazard" or "race" problems.

OR gate 53, simply combines signal pulses TA and TD into a general trigger signal T that is supplied to the count input of counter 52. The toggle flip-flop 54, on the other hand, generates a static up or down count-steering signal, so that in counter 52 arrival signals are counted up and departure signals are counted down. The output signal U from flip-flop 54 sets the steering elements of counter 52 appropriately before the trigger signal T is actually counted. Circuits 53 and 54 would be unnecessary if counter 52 were activated at separate terminals for up and down counts; however, the steering signal U is useful elsewhere.

One security feature of synchronization circuits 31 and 41 is the lack of multiple responses to multiple inputs. If, despite safeguards in the interface circuits of sensors 21–25, a multiple arrival or departure pulse is produced by any of the sensors, or the output from any of the sensors is chracterized by on-off bouncing, there is no adverse effect upon the synchronization circuits because the initial storage flip-flop in each synchronization circuit can be set just once during a complete clock cycle. Thus, only one timed arrival or departure pulse TA or TD is generated in any clock cycle. The timing diagram of FIG. 3 illustrates a number of relative timing relationships in the two synchronization circuits.

The vacancy indicator circuit 56 generates a vacancy signal V when (with certain exceptions) the storage count in counter 52 is zero, indicating that the number of departure signals has equalled the number of arrival signals. Counter 52, which provides the principal inputs to vacancy indicator 56, which provides the principal inputs to vacancy indicator 56, is conventional. The total capacity of the counter is a count of 255; an additional count would reset the counter to zero, but this overflow reset should be avoided. Counter 52 should be constructed to prevent counts below zero.

OR gate 57 generates a "significant count" output signal SC for any count greater than one in counter 52. For a count of one, if the steering signal U is false, indicating that departure signals are decrementing the counter 52, a significant count signal SC is also maintained. For any of these conditions, vacancy signal V is false, indicating that the transit zone being monitored is occupied.

On the other hand, if a count of one is recorded in counter 52 but steering signal U is true, then gate 59 is not enabled by its $\overline{U}$ input signal and the SC output of gate 57 is false. Similarly, the SC signal is always false for a count of zero in counter 52. For either of these conditions, a true vacancy signal V is generated.

The departure anticipation means comprising counter 46 and circuit 48 is an error correcting mechanism. Its function is to inject a phantom departure count into the zone monitor once during each occupancy of the zone by major traffic, in order to prevent a possible indefinite latch-up of zone monitor 20 in a false occupied state. The basis for correction or compensation is the development of an impending vacancy signal PD indicative of occurrence of a predetermined number of departure signals with no more than a much smaller given number of intervening arrival signals. Stated differently, the operation is based upon identification of departure of traffic that is most likely to lead to a vacant zone condition by detecting a substantial unbroken sequence of departing wheels.

Counter 46 is triggered only by the departure signal pulses TD and is reset to zero by any arrival signal pulse TA. When counter 46 reaches a count of twelve, the inputs to gate 49 are all true, producing a true output signal PD. This is the impending vacancy signal, which is applied to flip-flop 44 in departure synchronization circuit 41 as a phantom departure signal. A reset signal RD to flip-flop 44 occurs in time coincidence with the initiation of signal PD, but soon vanishes, leaving flip-flop 44 set by signal PD. During the next clock cycle the resulting stored "departure" signal D results in an output pulse TD that decrements the occupancy counter 52 in the usual manner, through circuits 45, 53 and 54.

The same phantom TD pulse also increments the departure counter 46 to a count of thirteen, thus, a static count of twelve cannot be maintained in counter 46. On reaching count thirteen in response to the phantom departure pulse, an AND gate 50 locks the counter at this count through the set input. The count in counter 46 can now be changed only by a reset signal constituting an arrival pulse signal TA.

In the normal operation of zone monitor 20, FIGS. 2 and 3, starting from an at-rest condition, clock 38 is cycling and the storage flip-flops 33, 34, 43, and 44 have all been reset to zero. The up-down counter steering signal U is false, the count in counter 52 is zero, departure counter 46 stores a count left over from prior traffic, and vacancy signal V is true.

As normal traffic enters zone 16 through any port, an arrival pulse signal L from the leading wheel of the first truck, as translated through arrival synchronization circuit 31 to the form of the timed arrival pulse TA, sets flip-flop 54 to afford a true output signal U. The same arrival signal TA increments accumulating counter 52 to a count of one and resets departure counter 46 to zero. With the U signal true, vacancy signal V remains true even though a count of one is now recorded in counter 52 and shown on display 55. The arrival signal from the second wheel of the entering traffic produces a second signal pulse TA that increments the count in counter 52 to two. Vacancy signal V now goes false, indicating that there is a significant count in counter 52. This may be shown on the display 62, to inform that transit zone 16 is occupied. Succeeding wheels continue to raise the cumulative count in counter 52, the total count being presented to a system operator through display 55.

In the simplest traffic situation, such as that presented by an isolated vehicle (e.g. a locomotive) traversing transit zone 16 from port 1 to port 3, a sequence of a small number of arrival signal pulses (L) is supplied to monitor 20 from sensor 21, followed by a pause during movement through zone 16, and then by a sequence of the same number of departure signal pulses (R) from sensor 23. Just after the first wheel exits, a timed departure pulse signal TD resets flip-flop 54 so that signal U becomes false. The same TD signal decrements the count in counter 52 by one and increments departure counter 46 to a count of one. This sequence continues until the cumulative count recorded in counter 52 is only one. At this point, because the steering signal U remains false, the vacancy signal V also remains false. The last exiting wheel now clears the transit zone, producing a final departure signal that clears counter 52 to a count of zero and restores vacancy signal V to true. Departure counter 46 retains the count of the number of wheels departing, in this instance assumed to be less than 12.

For somewhat more traffic, such as a few cars, operation is the same until, with the traffic leaving the zone, departure counter 46 counts to 12. At this point, the phantom departure pulse PD is injected into departure synchronization circuit 41, producing a TD pulse that increments counter 46 to a count of 13 where it is held in latched condition. In addition, the count in cumulative counter 52 is decremented by one additional count. Accordingly, counter 52 now holds a count of one less than the actual number of wheels still within zone 16. Departure signals continue; as the next-to-last wheel leaves the zone, counter 52 reaches a count of zero and vacancy signal V is restored to a true value even though one wheel remains within the zone. The final wheel has no effect when it passes from the zone because both of the counters 46 and 52 are stalled.

Operation is much the same for a train of many cars. However, for a train that is longer than the total distance between the arrival and departure ports used by that train, arrival signals may continue to be developed after departure signals start. The cumulative count in counter 52 then rises and falls by a few counts but hovers about the average number of wheels within the zone, while departure counter 46 accumulates a few counts but resets from time to time. After the last wheel arrives within the zone, further activities are exclusively departures. Counter 46 soon reaches a count of twelve and injects the phantom departure count PD. When counter 52 reaches a count of one, the vacancy signal V is restored to true, after which the final wheel of the train again departs with no additional effect.

These operations are the same regardless of which of the five ports of transit zone 16 are utilized as the arrival and departure ports. For example, normal operation proceeds, just as described above, even for a train that pulls part-way into zone 16, then stops and moves back out of the zone through the same port from which it entered.

The effectively monitored extent of transit zone 16 (FIG. 1) is slightly smaller than the zone that is bounded precisely by the locations of sensors 21–25. For both the arrival and departure ports used by any given traffic (arrival port only if just a few cars), a vacancy condition is indicated while a part of a vehicle intrudes to the zone side of the sensor location; the length of intrusion is the distance from the extreme end of the car to the second axle from that end, typically about ten feet.

Whenever long trains or streams of traffic may occur, the compatibility of the traffic capacity of zone 16 and the capacity of accumulating counter 52 must be considered. In monitor 20 (FIG. 2) the counter capacity is 255. For vehicles with two dual axle trucks, this is equivalent to sixty-four cars. For ordinary railroad cars this translates roughly into a maximum length of about 3,000 feet between ends of zone 16. That is, approximately 64 cars can enter zone 16 before any of them leave without overflow of counter 52. For very short cars, however, the maximum permissible port-to-port distance may shrink to about 2,000 feet. The zone and counter capacity sould be correlated to preclude a count exceeding the total capacity of counter 52, since an overflow resets the counter to zero, creating a totally indeterminate operation and a false vacancy indication.

Zone monitor 20 includes various arrangements for accommodating abnormal circumstances. In concept, the simplest of these is the treatment of the first wheel (or object) entering the monitored zone. The most complex is that afforded by departure counter 46 and phantom departure circuit 48.

As noted above, the first arrival signal for new traffic is counted 52, but does not lead to an indication of occupancy; the vacancy signal V persists as a true signal for this count of one in counter 52. The purpose of this arrangement is to avoid nuisance alarms which might otherwise result from a spurious arrival signal. False departure signals, on the other hand, are generally ignored, except for possible minor change in timing of the phantom departure signal PD. A single spurious arrival signal can easily be dealt with, as described; the penalties are, first, a small shrinkage or uncertainty in the length of the effective monitored zone, which can be taken into account in topographical planning, and second, a false incrementation of the cumulative counter 52, which in turn is dealt with by another part of the zone monitor.

The purpose of the departure anticipation means comprising counter 46 and circuit 48 is to eliminate the possibility of indefinite latch-up of the monitor in a state of indicated occupancy. Although this may be a safe situation, it takes the monitored zone 16 out of service. Without some corrective means, even one excess cumulative arrival count, whether caused by a spurious arrival signal input or by a missed departure signal input, by definition prevents counter 52 from emptying and hence may cause an indefinite occupancy indication. Two major problems must be solved by departure counter 46 and its associated circuits. The first is determination of appropriate circumstances that should lead to an act of correction and the second is the recognition and avoidance of potentially damaging side effects such as the introduction of a different and possibly worse type of error.

As to the first of these problems, effective correction of a potential excess arrival count, corrective action on an arbitrary and regular basis could be considered. However, it is more advantageous to key any correction to actual passage of traffic into and out of zone 16, because errors tend to be correlated with activity. For this reason, zone monitor 20 effectively infers the beginning of the end of traffic passage by identification of an unbroken sequence of departures. A premature conclusion in this regard could result from action based upon only a few departure signals. During continuous passage of a long train, a substantial number of wheels on a series of very short cars can depart between the arrivals of the leading and trailing trucks of a very long car. The number 12 has been selected as the basis for actuation of phantom departure circuit 48 as being slightly above the largest "false departure" number of reasonable probability in a conventional railway system. That number might be made greater or smaller, depending upon the likely characteristics of the traffic through a given transit zone in a particular traffic system.

The solution to the second problem noted above, related to side effects, is the avoidance of any drastic action. Any abrupt change of the cumulative count in counter 52 from a larger number to a small number would be an example of such drastic action. Instead, circuit 48 inserts just one phantom departure pulse to decrement counter 52 by just one count. Furthermore, this action is taken only for medium or large numbers of wheels. The net effect, when no error is actually present, is to shorten zone 16 at the departure port by the same amount as at the arrival port, that is, by the distance from the end of a car to the second axle from that end. If a single error of the excess-count type exists, the corrective action of phantom departure circuit 48 causes counter 52 to reach a zero count precisely upon exiting of the last wheel.

It two errors of an excess-count nature have occurred for one stream of traffic, only one is corrected and a false occupancy indication persists, but only until the next error-free passage or any passage with a deficit-type count. Large bursts of errors, especially those of the same nature, are quite unlikely. However, even multiple errors are eventually corrected; the only requirment, generally speaking, is an average of less than one error of the excess arrival type per traffic passage. Of course, the impending vacancy-phantom departure corrective action could be made to cycle two or even more times for long trains if local operating conditions appear to warrant such a revision, as by appropriate modification of latch gate 50 to allow recycling of counter 46 one or more times.

One side effect of an objectionable nature can in fact occur, but the probabiliby of serious trouble is very low. Normally, just one phantom down count occurs as traffic leaves the zone. If a long string of cars enters and stops when part way into the zone, and then backs up about three or four car lengths, a phantom departure signal is generated by circuit 48 and decrements counter 52. Another forward movement of at least one wheel past the sensor, at what constitutes both the arrival and departure port in this case, followed by another reverse movement of about three or four car lengths, results in the generation of another phantom departure signal PD by circuit 48. A continued sawing movement of that particular and unusual type could, at least in theory, decrement the count in counter 52 by an indeterminate amount.

As the train actually leaves the monitored zone, with a history of multiple unintended phantom departure counts, as described, the vacancy signal V is restored to its true value with most of a car instead of just one end still within the monitored zone. That is, a truncation of the zone by approximately one car length could occur. This is true even for a total of two, three, or even four such sawing movements, a quite unusual circumstance. Furthermore, this limited artificial shortening of the zone boundary would occur, in all probability, only as the train actually is moving away from the zone.

The illustrated system comprising zone monitor 20 is vulnerable to one additional operational hazard; it is not proof against coincident arrival pulses or coincident departure signals. These might occur if two independent elements of traffic were active at two ports simultaneously. In typical applications the zone would be arranged and operations restricted to minimize or preclude such joint activity for reasons of safety. Thus, a miscount from coincident pulses of the same nature, arrival or departure, is possible, but the probability is extremely low.

The purpose of the path indicator means comprising circuits 71 and 81 is to afford an indication of the successive ports of arrival and departure for any given traffic element. The technique employed is to set the flip-flops 76 and 77 in the departure path indicator 71, and the corresponding storage flip-flops in the arrival path indicator circuit 81, in response to the particular arrival and departure signals from specific ports that cause the vacancy signal V to change to its logical false and true states, respectively. Thus, in indicator 81 the arrival signal from a specific port is recorded in a corresponding flip-flop (in both flip-flops for port 3, as in indicator circuit 71). At the time the vacancy signal V goes false, the output signals AY and AX, identify the arrival port for a particular element of traffic. This is implemented by using the vacancy signal $\overline{V}$ to enable setting of the flip-flops in circuit 81. The same procedure applies in the departure path indicator circuit 71, in which a true vacancy signal V enables setting of flip-flops 76 and 77.

A minor complication stems from the relative timing of the various signals. The L and R arrival and departure signals from sensors 21-25 are brief and occur at varying times before the vacancy signal V changes state. This difficulty is overcome by the one-shot stretch circuits, such as circuits 74 and 75, that are interposed in the inputs to the storage flip-flops in the two path indicator circuits 71 and 81. The stretched L and R signals persist until after the timed arrival and departure signals TA and TD actuate counter 52 and the vacancy indicator circuit 56 responds.

The coding for the outputs AX, AY, DX and DY of indicator circuits 71 and 81 is simple binary notation. An arrival signal from port 1, sensor 21, is routed to a flip-flop serving as the least-significant-bit of a two-bit code, producing a true output on arrival path indicator terminal AY. An arrival signal for port 2 is related to the most-significant-bit position and produces a true output on terminal AX. An arrival signal from port 3, sensor 23, produces true output signals on both of the terminals AY and AX. Arrival signals from the combination of ports 4 and 5 are unused in the indicator circuits and hence result in a zero-zero readout at the arrival indicator terminals AY and AX, corresponding to the last two digits of a three-bit binary numeral four. A corresponding coding arrangement applies to the departure path indication outputs DY and DX.

In operation, the path indicator signal outlets AX, AY, DX and DY are active at all times. When vacancy signal V goes false, so that $\overline{V}$ is true, recording of arrival signals in the flip-flops of path indicator circuit 81 is enabled. Thus, the information available at terminals AX and AY is updated when traffic first arrives in the monitored zone and is kept current during the passage of traffic through the zone. When vacancy signal V again goes true, and $\overline{V}$ goes false, the recorded arrival path data remains in storage and the departure path indicator flip-flops are set in similar manner. That is, the departure path indicator circuit 71, and particularly the data recorded in flip-flops 76 and 77, is updated until the end of passage of the traffic from the zone. In both instances, the recorded data is retained indefinitely until changed by a new traffic incident. Although arrival port identification information is available early, in general it is preferred to limit recognition of the traffic path to the data available during an indicated vacancy, actuating path display 80 only when vacancy signal V first goes true. The path shown at that time identifies the combination of arrival and departure ports used by the last previous traffic and affords a true indication of the path such traffic has taken in moving through the transit zone.

Figure 4:
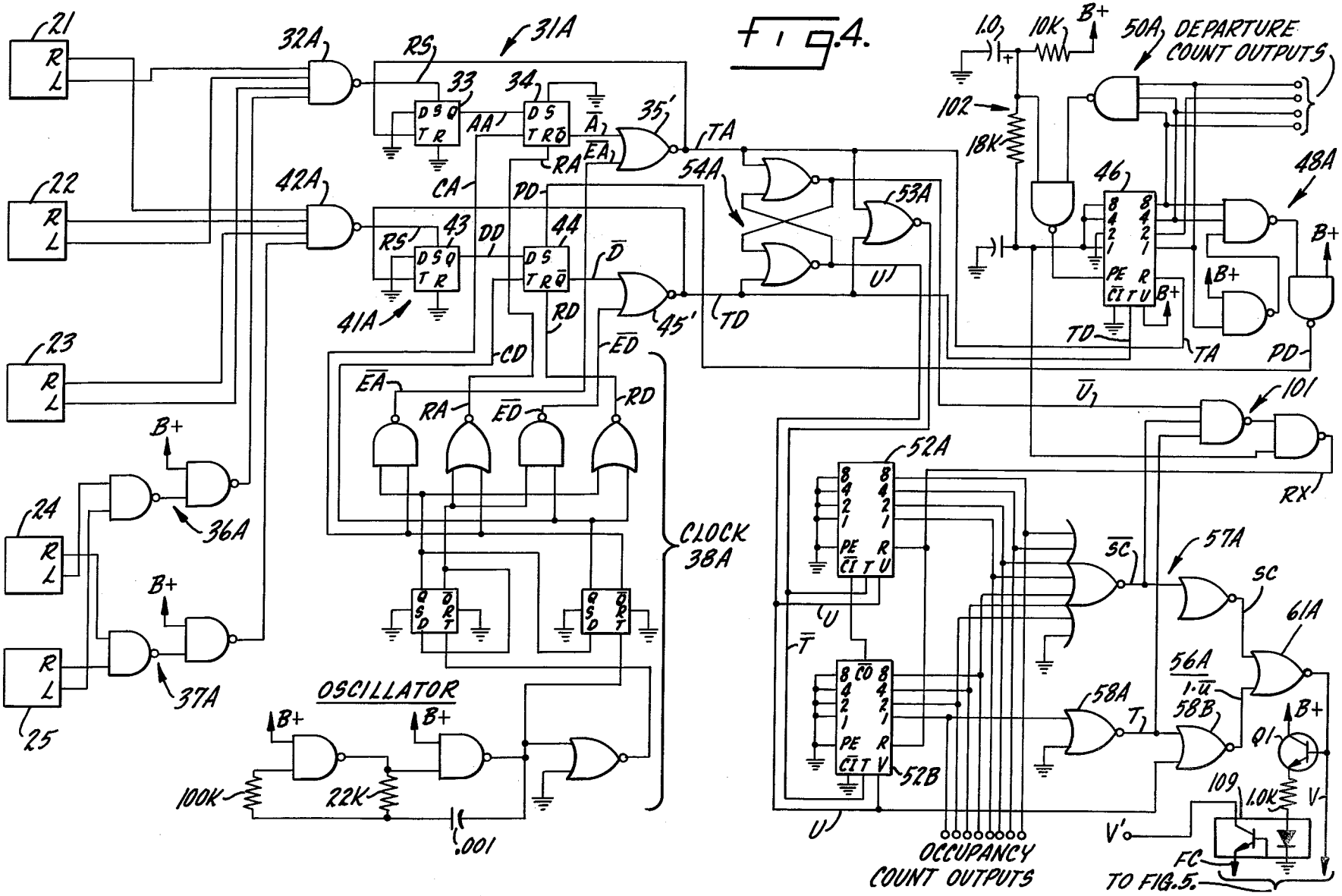
FIG. 4 is a detailed schematic diagram of the occupancy determination circuits for a zone monitor constructed in accordance with a specific embodiment of the invention.

FIG. 4 affords a detailed schematic diagram of the occupancy determination circuits for a zone monitor constituting a specific embodiment of the invention. The construction illustrated in FIG. 4 includes arrival and departure synchronization circuits 31A and 41A, together with a clock 38A that controls sync timing. Also shown are the circuits for the departure anticipation means, comprising departure counter 46, a phantom departure determination circuit 48A, and a latching circuit 50A. In this embodiment the up-down accumulating occupancy counter 52 comprises two individual interconnected counter units 52A and 52B and a vacancy indicator circuit 56A. An additional electrically isolated vacancy signal output is provided through a transistor Q1 and an optical cell 109.

In the construction shown in FIG. 4, the basic functions and the sequence of operations are the same as for the corresponding portion of the complete zone monitor illustrated in FIG. 2; accordingly, corresponding reference characters have been used throughout with the addition of letter designations (e.g. 31–31A; 52–52A, 52B), in many instances, particularly those instances in which the particular construction shown in detail in FIG. 4 is specifically different from the arrangements illustrated in FIG. 2. The signal designations in FIG. 4 also correspond to those of FIG. 2, with appropriate indication in those instances in which the invert of a signal is employed in the particular logic of FIG. 4. Specific component parameters are also shown in FIG. 4. FIG. 4 incorporates additional circuits 101 and 102 for resetting the occupancy counter 52A, 52B and the departure counter 46 for particular circumstances. Essentially, circuit 101 resets the occupancy counter to zero in response to initiation of a power-on condition and circuit 102 performs the same function with respect to departure counter 46. Circuit 101 further precludes the development of a departure count beyond zero, in the occupancy counter, in those instances when an excessive number of departure signals may occur. In FIG. 4, all gates are 4000 series CMOS integrated circuit units, counters 46, 52A and 52B are Type 14516, device 109 is Type 4N37 and transistor Q1 is Type 2N3904; the B+ supply is 12 volts.

Figure 5:
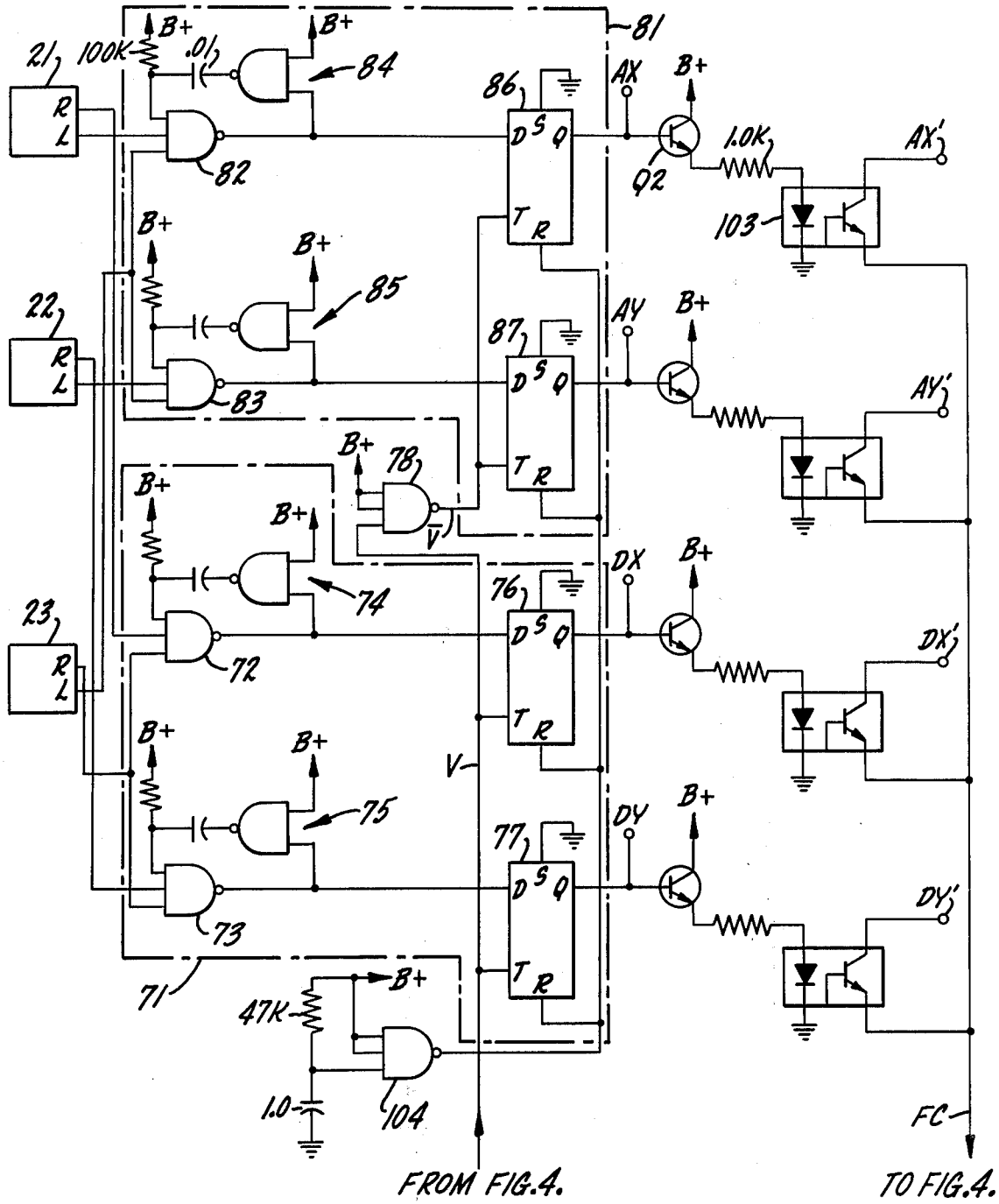
FIG. 5 is a detailed schematic diagram of path indicator circuits used in conjunction with the occupancy determination circuits of FIG. 4.

FIG. 5 constitutes a detailed schematic diagram of path indicator circuits for use in conjuction with the occupancy determination circuits shown in FIG. 4. In FIG. 5, both the departure path indicator circuits 71 and the arrival path indicator circuits 81 are shown in full, the arrival path circuit unit 81 includes input gates 82 and 83 corresponding to departure stretch circuits 74 and 75, and arrival signal storage flip-flops 86 and 87 performing the functions corresponding to those of departure flip-flops 76 and 77. In addition to the four path indicator outputs AX, AY, DX and DY that are provided in the zone monitor 20 of FIG. 2, the path indicator construction shown in FIG. 5 incorporates four additional path indicator outputs AX', AY', DX' and DY', each isolated from the direct outputs by a circuit comprising a transistor driving an optical cell, such as transistor Q1 and optical cell 103 in the circuit coupling terminal AX to terminal AX'. A power-on reset circuit 104 for flip-flops 76, 77, 86 and 87 is also incorporated in the circuit of FIG. 5.

In FIG. 5, as in FIG. 4, specific circuit parameters are included. For duplicated circuits, the circuit parameters are set forth only one time. All gates shown are 4000 series CMOS integrated circuit units, all flip-flops are Type 4013, all transistors are Type 2N3904 and all optical cells are Type 4N37; the B+ supply is 12 volts. For both FIGS. 4 and 5, the specific circuit parameters and CMOS and other unit types are set forth solely by way of illustration and in no sense as a limitation on the invention. It will be recognized that the zone monitor of the present invention can be implemented with quite different circuit components (e.g., conventional TTL components) or even through a properly programmed computer unit (e.g., a 8008/8080 miniprocessor).

I claim:

1. A zone monitor circuit for monitoring the occupancy of a transit zone having plural ports, each port including sensor means for generating an arrival signal indicative of movement of a vehicle or other movable object into the transit zone through that port and for generating a departure signal indicative of movement of an object out of the zone through that port, comprising:

synchronization means, coupled to the sensor means, for developing synchronized arrival signals and departure signals segregated from each other on a time basis;

occupancy counter means, coupled to the synchronization means, for maintaining a continuous count of the number of arrival signals minus the number of departure signals to afford an occupancy count representative of the number of objects within the zone;

and departure anticipation means, coupled to the synchronization means, for developing an impending vacancy signal indicative of occurrence of a predetermined number of departure signals with no more than a much smaller given number of intervening arrival signals.

2. A zone monitor circuit according to claim 1 in which the departure anticipation means comprises a departure counter for counting departure signals and means for resetting the departure counter in response to occurrence of said given number of arrival signals.

3. A zone monitor circuit according to claim 2 in which said given number of arrival is one.

4. A zone monitor circuit according to claim 1 and further comprising decrementing circuit means for decrementing the occupancy count by a given small number in response to an impending vacancy signal.

5. A zone monitor circuit according to claim 4, in which the synchronization means inludes a departure signal storage device for short-term storage of departure signals, and in which the decrementing circuit means comprises a circuit for applying an impending vacancy signal to the departure signal storage device for short-term storage as a phantom departure signal.

6. A zone monitor circuit according to claim 1 in which the synchronization means comprises:

arrival signal storage means for recording each arrival signal as it occurs;

arrival signal readout/reset means for reading out a recorded arrival signal from the arrival signal storage means and resetting the arrival signal storage means for recording another arrival signal;

departure signal storage means for recording each departure signal as it occurs;

departure signal readout/reset means for reading out a recorded departure signal from the departure signal storage means and resetting the departure signal storage means for recording another departure signal;

clock means for generating a plurality of timing control signals;

and clock coupling means, coupling the clock means to both readout/reset means, for supplying the timing control signals to the two readout/reset means for actuation at successive mutually exclusive time intervals.

7. A zone monitor circuit according to claim 6, in which each of the arrival and departure signal storage means comprises a preliminary storage stage in series with a secondary storage stage, in which the clock means includes means for generating two arrival timing control signals EA and RA and two departure timing control signals ED and RD recurring in the mutually exclusive time sequence EA, RA, ED, RD, EA. . . , and in which the clock coupling means comprises means for applying those timing control signals to the arrival and departure storage means to actuate the following:

EA — readout from secondary arrival storage stage and reset preliminary arrival storage stage;

RA — reset secondary arrival storage stage;

ED — readout from secondary departure storage stage and reset preliminary departure storage stage; and RD — reset secondary departure storage stage.

8. A zone monitor circuit according to claim 7, in which the clock means includes means for generating two additional timing control signals CA and CD recurring in the mutually exclusive time sequence CA, CD, CA. . . , the signal CA coinciding in time with the signals RD and EA and the signal CD coinciding in time with the signals RA and ED, and in which the clock coupling means comprises means for applying the signals CA and CD to the arrival and departure storage means to actuate the following:

CA — record stored arrival signals from the preliminary arrival stage in the secondary arrival stage; and CD — record stored departure signals from the preliminary departure stage in the secondary departure stage.

9. A zone monitor circuit according to claim 8, and further comprising:

decrementing circuit means for applying an impending vacancy signal from the departure anticipation means to the secondary departure storage stage for recording therein as a phantom departure signal to thereby decrement the occupancy count in the occupancy counter means by one count.

10. A zone monitor circuit according to claim 1 and further comprising:

path indicator means, having inputs coupled to all of the sensor means, for generating path indication signals indicative of the last active ports of origin of arrival and departure signals.

11. A zone monitor circuit according to claim 10, in which the occupancy counter means includes vacancy indicator means for developing a vacancy signal whenever the occupancy count is approximately zero, and in which the path indicator means includes a further input coupled to the vacancy indicator means, whereby the path indicator means generates path indication signals indicative of the last active ports of origin of arrival and departure signals just prior to occurrence of a vacancy signal.

12. A zone monitor circuit according to claim 11, in which the path indicator means comprises a plurality of departure signal storage devices and a corresponding plurality of arrival signal storage devices having input and output connections affording binary encoded path indication signals.

13. A zone monitor circuit according to claim 11, in which the synchronization means comprises:

arrival signal storage means for recording each arrival signal as it occurs;

arrival signal readout/reset means for reading out a recorded arrival signal from the arrival signal storage means and resetting the arrival signal storage means for recording another arrival signal;

departure signal storage means for recording each departure signal as it occurs;

departure signal readout/reset means for reading out a recorded departure signal from the departure signal storage means and resetting the departure signal storage means for recording another departure signal;

clock means for generating a plurality of timing control signals;

and clock coupling means, coupling the clock means to both readout/reset means, for supplying the timing control signals to the two readout/reset means for actuation at successive mutually exclusive time intervals;

and in which the path indicator means includes delay means, in each arrival and departure signal input, to compensate for delay introduced by operation of the synchronization means and the occupancy counter means.

14. A zone monitor circuit according to claim 11 and further comprising decrementing circuit means for decrementing the occupancy count by a given small number in response to an impending vacancy signal.

15. A zone monitor circuit according to claim 14 in which the synchronization means includes a departure signal storage device for short-term storage of departure signals, and in which the decrementing circuit means comprises a circuit for applying an impending vacancy signal to the departure signal storage device for short-term storage as a phantom departure signal.

16. A zone monitor, for monitoring the occupancy of a transit zone having plural ports, each port including sensor means for generating an arrival signal indicative of movement of a vehicle or other movable object into the transit zone through that port and for generating a departure signal indicative of movement of an object out of the zone through that port, comprising:

synchronization means, coupled to all of the sensor means, for developing synchronized arrival signals and departure signals segregated from each other on a time basis;

occupancy counter means, coupled to the the synchronization means, for maintaining a continuous count of the number of arrival signals minus the number of departure signals to afford an occupancy count representative of the number of objects within the zone;

the occupancy counter means including vacancy indicator means for developing a vacancy signal whenever the occupancy count is approximately zero;

and path indicator means, coupled to the vacancy indicator means and to the sensor means, for generating path indication signals indicative of the last active ports of origin of arrival and departure signals occurring just prior to occurrence of a vacancy signal.

17. A zone monitor circuit according to claim 16, in which the path indicator means comprises a plurality of departure signal storage devices and a corresponding plurality of arrival signal storage devices having input and output connections affording binary encoded path indication signals.

18. A zone monitor circuit according to claim 17, in which the synchronization means comprises:

arrival signal storage means for recording each arrival signal as it occurs;

arrival signal readout/reset means for reading out a recorded arrival signal from the arrival signal storage means and resetting the arrival signal storage means for recording another arrival signal;

departure signal storage means for recording each departure signal as it occurs;

departure signal readout/reset means for reading out a recorded departure signal from the departure signal storage means and resetting the departure signal storage means for recording another departure signal;

clock means for generating a plurality of timing control signals;

and clock coupling means, coupling the clock means to both readout/reset means, for supplying the timing control signals to the two readout/reset means for actuation at successive mutually exclusive time intervals;

and in which the path indicator means includes delay means, in each arrival and departure signal input, to compensate for delay introduced by operation of the synchronization means and the occupancy counter means.

* * * * *

UNITED STATES PATENT AND TRADEMARK OFFICE

CERTIFICATE OF CORRECTION

PATENT NO. : 4,070,560
DATED : January 24, 1978
INVENTOR(S) : Carl G. Blanyer

It is certified that error appears in the above-identified patent and that said Letters Patent are hereby corrected as shown below:

Col. 4, line 9, change "descirbed" to --described--;

Col. 5, line 47, change "output" to --outputs--;

Col. 7, line 24, cancel the comma after "53";

Col. 7, lines 55 and 56, cancel "which provides the principal inputs to vacancy indicator 56,";

Col. 10, line 15, change "sould" to --should--;

line 26, after "counted" insert -- , in counter-- ;

Col. 11, line 27, change "It" to -- If--;

Col. 14, line 55, after "arrival" insert --signals--;

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*